United States Patent [19]

Heebink

[11] 4,007,730

[45] Feb. 15, 1977

[54] FIREPLACE DAMPER

[76] Inventor: Fredrick Heebink, 1370 Eighth Ave., Baldwin, Wis. 54002

[22] Filed: May 30, 1975

[21] Appl. No.: 582,381

[52] U.S. Cl. ..... 126/286; 98/59; 126/288

[51] Int. Cl.[2] ..... F23L 11/00

[58] Field of Search ..... 126/286, 288; 98/58, 98/59, 60, 78, 79; 90/45, 46

[56] References Cited

UNITED STATES PATENTS 3,267,832 8/1966 Hinkle ..... 98/59

*Primary Examiner*—Ronald C. Capossela

[57] ABSTRACT

A damper designed to close the top of a fireplace chimney provided with a spring urging the same open and a second and stronger spring attaching the damper to a cable which extends down the chimney for purposes of opening and closing the damper, a lever being provided in the fireplace for locking the damper in either open or closed position, the damper being attached to the top of the chimney flue by means of an adjustable bracket.

3 Claims, 1 Drawing Figure

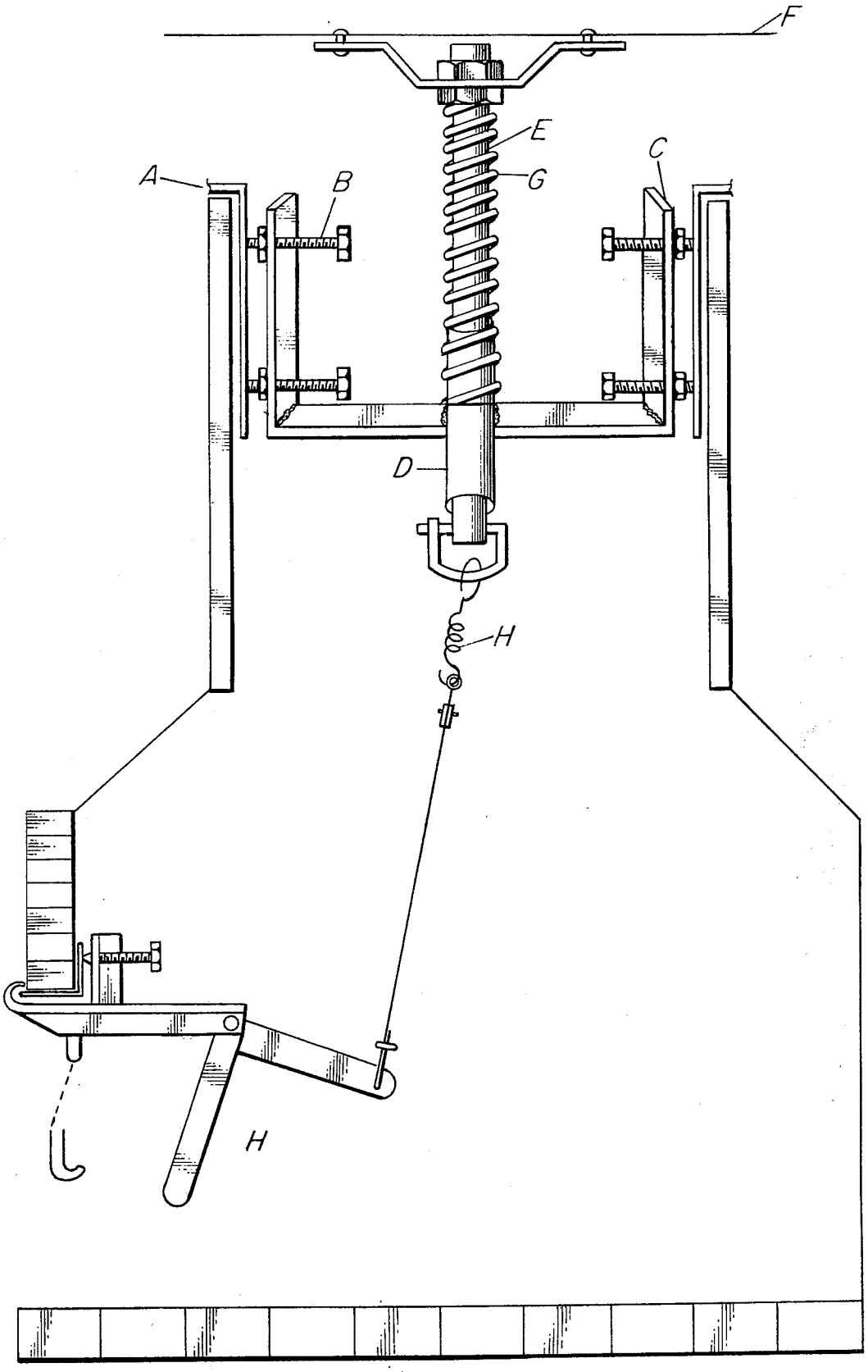
F
E
C
A
B
G
D
H
H

FIREPLACE DAMPER

The fireplace damper I have designed and built is located at the top of the chimney flue. It can be opened and closed with a lever device, that is attached to the lintinal support of the fireplace.

The damper has three advantages; It will prevent almost all heat loss from a warm room, when the fireplace is not being used. By closing this damper a vacuum will be elimenated in the chimney. This vacuum is created when wind currents blow across the top of the chimney. This vacuum will cause a draw of heat when the damper is located in the dome of the fireplace.

This damper also prevents rain and snow from entering the chimney. Plus, it also prevents down drafts when the fireplace is being used.

DESCRIPTION OF DRAWING

This drawing is a side cut out view of a fireplace and chimney flue. The chimney flue is being drawn short, to make possible a larger drawing of the damper mechanism.

The damper is located at the top of the chimney flue. It is mounted diagonally inside a square or rectangular type of flue or across the diameter of a circular flue.

It is held in place by two straps of steel A bent at a 90° angle to fit over the top edge of the chimney flue. A is held tightly against the flue by four bolts B. Bolts are fit in holes in iron A and are slightly smaller at the end where they fit in a hole, then riveted to hold securely.

Portion C is made from 90° angle iron (or other rigid materials) bent and welded at a 90° angle to make a rigid U-shaped frame. At center of horizontal part of iron C, a pipe D is welded to support rod E in an upright position. Rod E fits loosely in the pipe to allow the rod to move up and down freely. Rod E is threaded on upper end to fasten damper F, which is made from a rigid fireproof material.

Spring G fits over rod E and pipe D to hold damper in open position.

At the bottom of the rod E a spring H is attached that is slightly stronger than spring G to insure damper is held tightly closed. To bottom end of spring H a cable is attached which leads to lever assembly, which pulls and locks damper to a closed position.

I claim:

1. A chimney top damper assembly including:

A. a damper plate adopted to cover the top of a chimney flue,

B. a supporting rod attached to the center of said plate normal to the plane thereof, C. said rod being slidably attached to a holding bracket, said bracket being adapted to engage the sides of said chimney flue, D. spring means engaging said bracket on one end and said plate on the opposite end positioned to urge said plate upwardly, E. spring means attached to the lower end of said rod, said spring providing stronger resistance to extensive force than said first spring, F. cable means attached to said spring and adapted to extend downwardly to the bottom of said chimney, G. means for attaching the lower end of said cable to a fireplace, H. said later attaching means being provided with pivotable means for extending said cable to close said damper plate and releasing said cable to open said damper plate.

2. An assembly according to claim 1 wherein said holding bracket B has two arms adapted to engage opposite sides of said chimney and being provided with screw means to positively engage said flue.

3. An assembly according to claim 2 wherein said bracket is laterally adjustable and thereby adapted to engage chimney flues of different diameters.

* * * * *